US006945204B2

(12) United States Patent
Gecim et al.

(10) Patent No.: US 6,945,204 B2
(45) Date of Patent: Sep. 20, 2005

(54) ENGINE VALVE ACTUATOR ASSEMBLY

(75) Inventors: Burak A. Gecim, Rochester Hills, MI (US); William R. Kuziak Jr., Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/706,069

(22) Filed: Nov. 12, 2003

(65) Prior Publication Data

US 2005/0098135 A1 May 12, 2005

(51) Int. Cl.[7] ..... F01L 9/02

(52) U.S. Cl. ..... 123/90.12; 123/90.39; 123/90.45

(58) Field of Search ..... 123/90.12, 90.13, 123/90.33, 90.36, 90.39, 90.4, 90.41, 90.43, 123/90.44, 90.45, 90.46

(56) References Cited

U.S. PATENT DOCUMENTS

| | | | | |
|---|---|---|---|---|
| 1,703,858 A | | 3/1929 | Banner | |
| 2,935,048 A | * | 5/1960 | Geyer | 92/111 |
| 3,157,166 A | | 11/1964 | MacNeill | |
| 4,009,695 A | | 3/1977 | Ule | |
| 4,188,933 A | | 2/1980 | Iizuka | |
| 4,459,946 A | | 7/1984 | Burandt | |
| 4,587,936 A | | 5/1986 | Matsuura et al. | |
| 5,373,818 A | | 12/1994 | Unger | |
| 5,485,813 A | * | 1/1996 | Molitor et al. | 123/90.12 |
| 5,655,487 A | | 8/1997 | Maas et al. | |
| 5,682,846 A | * | 11/1997 | Scharnweber | 123/90.12 |
| 5,720,244 A | | 2/1998 | Faria | |
| 5,749,340 A | * | 5/1998 | Warburton et al. | 123/90.16 |
| 6,085,705 A | | 7/2000 | Vorih | |
| 6,112,711 A | | 9/2000 | Shimizu et al. | |
| 6,536,388 B2 | * | 3/2003 | Lou | 123/90.12 |
| 6,536,391 B2 | | 3/2003 | Kunz | |
| 6,688,267 B1 | | 2/2004 | Raghavan | |
| 6,732,687 B2 | * | 5/2004 | Djordjevic | 123/90.16 |
| 2003/0015155 A1 | | 1/2003 | Turner et al. | |
| 2003/0172885 A1 | | 9/2003 | Gaessler et al. | |

* cited by examiner

*Primary Examiner*—Thomas Denion
*Assistant Examiner*—Ching Chang
(74) *Attorney, Agent, or Firm*—Kathryn A. Marra

(57) ABSTRACT

A valve actuator assembly for an engine includes a movable engine valve. The valve actuator assembly also includes a movable finger for contact with the engine valve and a rotatable cam for contact with the finger. The valve actuator assembly further includes a finger-support element assembly for contact with the finger having a first piston and a second piston. The first piston and second piston are axially aligned and independently movable in the same direction to provide lift of the engine valve in an activated mode and lost motion of the engine valve in a de-activated mode. In the activated mode, one end of the second piston is the stationary pivot for the finger, and the other end contacts the first piston. The first piston rests on a fluid column. In the de-activated mode, fluid is exhausted hydraulically, yielding lost motion, and the two pistons are displaced away from each other by their biasing springs. The first piston remains stationary, and the second piston undergoes a reciprocating motion.

25 Claims, 7 Drawing Sheets

ENGINE VALVE ACTUATOR ASSEMBLY

TECHNICAL FIELD

The present invention relates generally to intake or exhaust valve actuators for internal combustion engines and, more particularly, to a hydraulic-lost-motion based variable valve actuator assembly for an internal combustion engine.

BACKGROUND OF THE INVENTION

Typically, a valve train for an internal combustion engine includes one or more valves, a camshaft having one or more cam lobes, and a follower contacting each cam lobe and valve. The valve train may also include a hydraulic lash adjuster, which may serve as a pivot for a finger type cam follower.

Variable valve actuation mechanisms have been extensively developed and to some extent utilized to improve efficiency of the internal combustion engine, also to improve idle stability, power output, and emissions. These improvements are achieved by controllably varying the valve lift, timing, and duration. The ability to vary one or more of these valve-event attributes, either discretely or continuously depends on the complexity of the actuating mechanism. For an overhead-cam valvetrain employing a finger follower, discrete variations in the valve lift profile can be achieved by cam-lobe switching. However, cam-lobe switching mechanisms are complicated and bulky because they require at least three follower surfaces where outer surfaces are required to maintain balance with one existing pivot point, and only one of the three surfaces is likely to be a rolling type due to limited available total width. The two outer follower surfaces are usually of a sliding type, each having a small width with high specific loading. In addition, these mechanisms require a high-pressure oil supply for actuation of different segments of the follower corresponding to cam lobes being switched. This necessitates machining of additional oil passages.

For an overhead-cam valve train employing a finger follower, the pivot support element, which may also serve as a lash adjuster, could provide valve de-activation. A mechanism, employing two concentric bodies with a freedom for axial relative motion, can be actuated to switch between a fully-extended and a fully-collapsed position. Spring-biased pins located on one body can be hydraulically displaced to engage into receiving holes on the other body for holding in the fully-extended position. However, a pin-engagement mechanism requires precise alignment of the pins with the receiving holes. Furthermore, a pin-engagement mechanism lacks the flexibility to yield intermediate positions between the fully extended and the fully collapsed limits.

As a result, it is desirable to provide a valve actuator assembly for an engine that has valve-deactivation for an overhead-cam valve train. It is also desirable to provide a valve actuator assembly for an engine that has discrete-step variable valve actuation. Therefore, there is a need in the art to provide a valve actuator assembly for an engine that meets these desires.

SUMMARY OF THE INVENTION

It is, therefore, one object of the present invention to provide a new valve actuator assembly for an engine.

It is another object of the present invention to provide a valve actuator assembly for an engine that allows for de-activation of an engine valve.

It is yet another object of the present invention to provide a valve actuator assembly for an engine that has discrete-step variable valve actuation.

Accordingly, the present invention is a valve actuator assembly for an engine. The valve actuator assembly includes a movable engine valve. The valve actuator assembly also includes a movable finger for contact with the engine valve and a rotatable cam for contact with the finger. The valve actuator assembly further includes a finger-support element assembly for contact with the finger having a first piston and a second piston. The first piston and second piston are axially aligned and independently movable in the same direction to provide lift of the engine valve in an activated mode and lost motion of the engine valve in a de-activated mode.

The present invention provides for an overhead-cam valve train of an engine. One advantage of the present invention is that the valve actuator assembly has valve-deactivation for an overhead-cam valve train. Yet another advantage of the present invention is that the valve actuator assembly has discrete-step variable valve actuation. Still another advantage of the present invention is that the valve actuator assembly improves engine efficiency by either de-activating the entire cylinder (all exhaust and intake valves of that cylinder) or by de-activating selected valves of the cylinder for reducing intake charge when power demand is low. A further advantage of the present invention is that the valve actuator assembly, when used alone, provides a mechanism to switch between a full primary lift in an activated mode and no lift in a de-activated mode. Still a further advantage of the present invention is that the valve actuator assembly could be employed as a de-activating finger support element in a valvetrain where an independent mechanism, such as two-stepping finger, achieves the two-step valve lift. Another advantage of the present invention is that the valve actuator assembly may be used to deactivate an engine valve while a secondary cam profile is active on a two-stepping finger, yielding a shorter lost motion stroke. Yet another advantage of the present invention is that the valve actuator assembly incorporates a finger-support element with controllable height, which enables discrete variations in valve lift for an overhead-cam valvetrain. Still another advantage of the present invention is that the valve actuator assembly enables the valvetrain to yield two-step valve lift, improving engine efficiency. A further another advantage of the present invention is that the valve actuator assembly improves engine efficiency by running on a low-lift when power demand is low, and, by proper timing of the low lift, improves engine idle stability. A further advantage of the present invention is that the valve actuator assembly achieves discrete-step variation in engine-valve operation by use of a hydraulic-lost-motion lash-adjusting component similar to the lash-adjusting component of an overhead-cam valve train it replaces.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIGS. 4 through 6 are fragmentary elevational views of the valve actuator assembly of FIG. 1 in various positions.

FIGS. 7 through 9 are fragmentary elevational views of another embodiment, according to the present invention, of the valve actuator assembly of FIG. 1 in various positions.

DESCRIPTION OF THE PREFERRED EMBODIMENT

Figure 1:
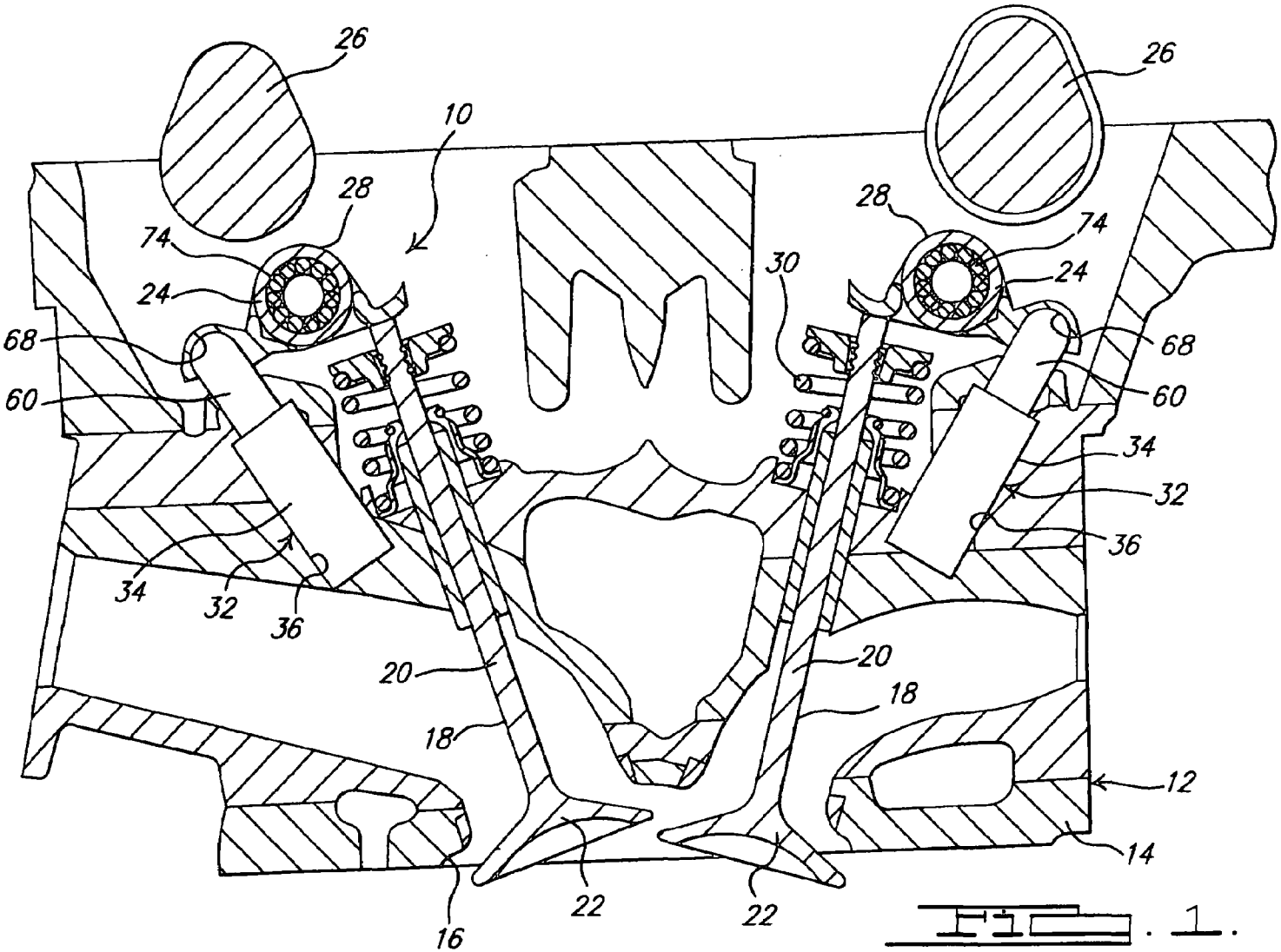
FIG. 1 is a fragmentary elevational view of a valve actuator assembly, according to the present invention, illustrated in operational relationship with a portion of an engine.

Referring to the drawings and in particular FIG. 1, one embodiment of a valve actuator assembly 10, according to the present invention, is shown for an engine, generally indicated at 12 (partially shown), of a vehicle such as a motor vehicle (not shown). The engine 12 is of an internal combustion type. The engine 12 includes an engine head 14 having at least two, preferably a plurality of openings 16 therein in communication with at least one internal combustion chamber (not shown) of the engine. The engine 12 also includes at least two, preferably a plurality of movable engine valves 18, one valve 18 for each opening 16. Each of the engine valves 18 has a valve stem 20 and a valve head 22. Each engine valve 18 is movable to open and close its respective opening 16 between an open position and a closed position. It should be appreciated that the engine valves 18 may be intake and/or exhaust valves. It should also be appreciated that the valve actuator assembly 10 is an overhead-cam valve train for the engine head 14. It should further be appreciated that, except for the valve actuator assembly 10, the engine head 14 is conventional and known in the art.

Figure 2:
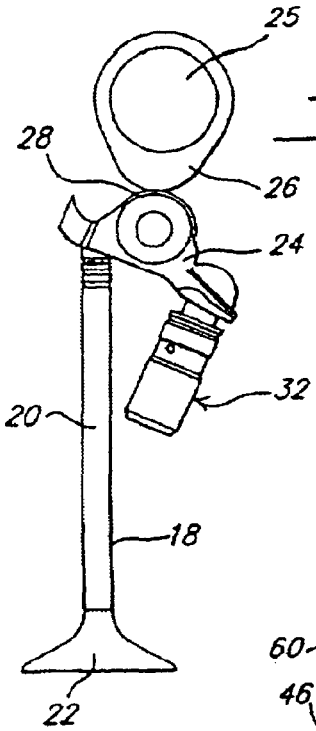
FIG. 2 is an elevational view of the valve actuator assembly of FIG. 1.
Figure 3:
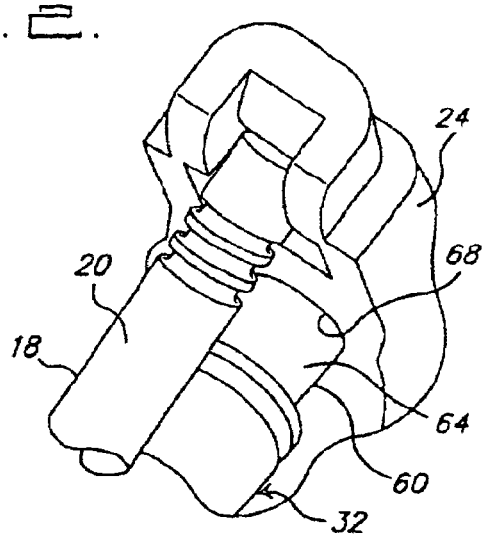
FIG. 3 is a perspective view of a portion of the valve actuator assembly of FIG. 1.

Referring to FIGS. 1 and 2, the valve actuator assembly 10 includes a rotatable finger 24 for each of the engine valves 18. The finger 24 for each engine valve 18 is rotatably supported by the engine head 14 and contacts an upper end of the stem 20 thereof. The valve actuator assembly 10 also includes a rotatable camshaft 25 having a cam lobe 26 for each finger 24. The camshaft 25 is rotatably supported by the engine head 14. Each cam lobe 26 contacts an upper surface 28 of their respective finger 24, which may be a roller, to rotate the finger 24. The valve actuator assembly further 10 includes an engine valve spring 30 disposed about the valve stem 20 and operatively supported by the engine head 14 to bias the engine valve 18 toward the closed position. It should be appreciated that the valve head 22 closes the opening 16 when the engine valve 18 is in the closed position.

The valve actuator assembly 10 also includes a finger-support element assembly, generally indicated at 32, for each engine valve 18 to control or de-activate their respective engine valve 18. In the embodiment illustrated in FIGS. 1 through 4, the finger-support element assembly 32 includes an outer casing or housing 34 disposed in a receiving bore 36 of the engine head 14. The receiving bore 36 has a circumferential groove or channel 38 at a lower end thereof and a circumferential groove or channel 40 at an upper end thereof that provide fluid supply to a high-pressure chamber 50 and lubrication channel 72 to be described. It should be appreciated that the finger-support element assembly 32 is orientated at an angle relative to a longitudinal axis of the engine valve 18. It should also be appreciated that orientation of the finger-support element assembly 32 relative to the engine valve 18 is such that pallet/valve-tip contact is secured.

The outer housing 34 extends axially and is generally cylindrical in shape. The outer housing 34 has an opening or passageway 42 at a lower end thereof and an opening or passageway 44 at an upper end thereof that fluidly communicates with the lower channel 38 and upper channel 40, respectively. The outer housing 34 also has an opening 46 extending axially through an upper end thereof for a function to be described. The outer housing 34 has a dividing wall 48 extending radially therein to divide the outer housing 34 into two chambers. The dividing wall 48 has an aperture 52 extending therethrough for a function to be described. It should be appreciated that the outer housing 34 is a monolithic structure being integral, unitary, and one-piece.

The finger-support element assembly 32 also includes a movable support piston 54 disposed within the outer housing 34. The support piston 54 has a head 56 extending radially and a shaft 58 extending axially from the head 56. The head 56 is disposed below the dividing wall 48, thereby forming a high-pressure chamber 50 and the shaft 58 extends through the aperture 52 in the dividing wall 48. An interface 59 between the support piston 54 and the outer housing 34 has a small clearance, on the order of five to ten micro-meters. It should be appreciated that the support piston 54 is a monolithic structure being integral, unitary, and one-piece.

The finger-support element assembly 32 includes a movable pivot piston 60 partially disposed within the outer housing 34. The pivot piston 60 extends axially and has a first end 62 for contact with the one end of the shaft 58 of the support piston 54 and a second end 64 for contact with the finger 24. The first end 62 includes a cavity 66 for receiving and contacting an end of the shaft 58 of the support piston 54. The second end 64 is generally arcuate in shape and contacts a receiving inner surface 68 of the finger 24. The pivot piston 60 includes a lubrication passageway or channel 70 extending axially therein from the second end 62 and radially therein near the first end 60. An interface 72 between the pivot piston 60 and the outer housing 34 has a large clearance, on the order of fifty (50) to one hundred (100) micro-meters. It should be appreciated that the pivot piston 60 is a monolithic structure being integral, unitary, and one-piece. It should also be appreciated that, due to the leakage of fluid through the large clearance at the interface 72 and ventilation holes (not shown), the top portion of the outer housing 34 guiding the pivot piston 60 does not retain any volume of lubricant such as oil. It should further be appreciated that the lubrication channel 70 provides a sufficient quantity of the lubricant to a spherical bearing 74 of the finger 24 as an inlet aperture 76 of the lubrication channel 70 registers with the channel 40. It should yet further be appreciated that discrete variations in lift of the engine valve 18 are achieved by controlling an axial position of the pivot piston 60. It should still further be appreciated that the motion of the support piston 54 is separate or independent from the motion of the pivot piston 60.

The finger-support element assembly 32 also includes a first spring 78 disposed in the outer housing 34 about the shaft 58 between the head 56 of the support piston 54 and the dividing wall 48 of the outer housing 34. The first spring 78 is of a coil type, made of a spring material. The finger-support element assembly 32 further includes a second spring 80 disposed in the outer housing 34 between the first end 62 of the pivot piston 60 and the dividing wall 48 of the outer housing 34. The second spring 80 is of a coil type, made of a spring material. It should be appreciated that the second spring 80 is sufficiently stiff to maintain contact between the moving valvetrain parts in a valve-deactivated mode, but soft enough not to actuate the engine valve 18. It should also be appreciated that the first spring 78 and second spring 80 act on the support piston 54 and pivot piston 60, respectively. It should further be appreciated that the displacement of the support piston 54 against the first spring 78 is controlled by engine-oil or lubricant pressure. It should yet further be appreciated that both the micro displacement of the support piston 54 required for leakdown compensation in a valve-active mode and its full-stroke motion for a re-activation from the de-activated mode rely on the available lubricant pressure to overcome the force of the first spring 78. It should still further be appreciated that the overall height of the finger-support element assembly 32 is primarily a function of the full lost-motion stroke and compressed heights of the springs 78 and 80.

The valve actuator assembly 10 further includes a control valve 82 to control the operation of the finger-support element assembly 32. In the embodiment illustrated, the control valve 82 includes a chamber 83 and a movable spool valve 84 disposed within the chamber 83. The spool valve 84 is of a two-position, three-way type. The control valve 82 has a driving or chamber port 85 on the chamber 83 fluidly connected by an intermediate channel 86 to the channel 38 of the finger-support element assembly 32. The control valve 82 also includes a high-pressure port 88 on the chamber 83 and a low-pressure port 90 on the chamber 83. The control valve 82 includes an actuator 91 at one end of the spool valve 84. The actuator 91 is of a linear type such as a solenoid electrically connected to a source of electrical power such as a controller (not shown). The control valve 82 also has a spring 92 at the other end of the spool valve 84 to bias the spool valve 84 toward one end of the chamber 83. It should be appreciated that the control valve 82 controls fluid flow to and from the high-pressure chamber 50 of the finger-support element assembly 32.

The valve actuator assembly 10 further includes a one-way flow valve 94 in fluid communication with the control valve 82. In the embodiment illustrated, the one-way flow valve 94 includes a chamber 96 and a movable valve element 98 disposed within the chamber 96. The valve element 98 is of a ball type. The one-way flow valve 94 also includes an inlet pressure port 100 on the chamber 96 and an outlet pressure port 102 on the chamber 96. The one-way flow valve 94 also has a valve element spring 104 at one end of the valve element 98 to bias the valve element 98 toward one end of the chamber 96. It should be appreciated that fluid pressure in the chamber 96 of the flow valve 94 overcomes the force of the valve element spring 104 and moves the valve element 98 when the pressure in the high-pressure chamber 50 drops below the pressure in the chamber 96. It should also be appreciated that the valve element 98 seals the high-pressure chamber 50 and prevents out flow from the high-pressure chamber 50 when the fluid pressure in the high-pressure chamber 50 exceeds the fluid pressure in the chamber 96.

The valve actuator assembly 10 further includes a lubricant source 106 and a pressure line 108 fluidly connected to the lubricant source 106 and the inlet port 100. The valve actuator assembly 10 further includes a pressure line 109 fluidly connected to the outlet port 102 and the high-pressure port 88 on the control valve 82.

In a null position, the spool valve 84 is controlled by the valve spring 92 where the input port receives lubricant at a pressure close to a lubricant source pressure (considering the pressure drop across the one-way flow valve 94). During the base-circle portion of the valve event, where the valve actuator assembly 10 is essentially unloaded, except the reaction force from the preloading of the second spring 80, any micro lost motion due to leakdown during previous valve event in the valve-active mode, is compensated by the upward displacement of the support piston 54 against the first spring 78. It should be appreciated that the control valve 84 and one-way flow valve 94 provide fluid communication between the high-pressure chamber 50 and the lubricant source 106.

Figure 4:
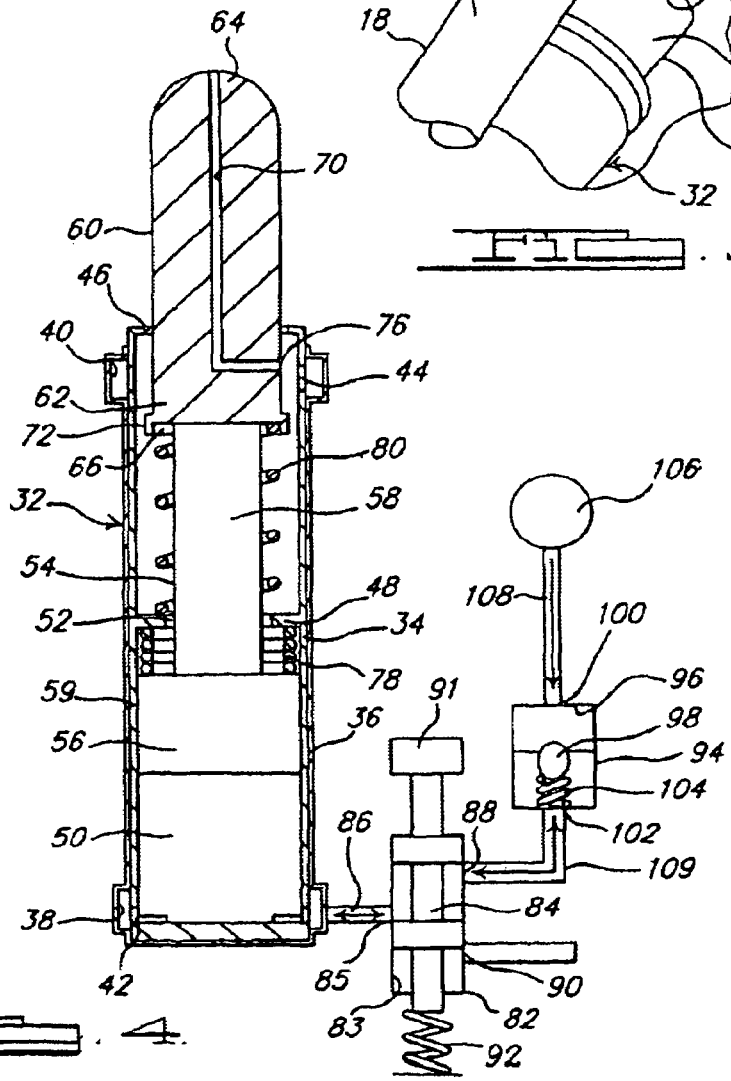

In the fully-expanded (valve-active) mode of the finger-support element assembly 32 as illustrated in FIG. 4, the support piston 54 provides axial support to the pivot piston 60, where the reaction force generated at the finger 24 in response to the force of the engine valve spring 30 is transferred to the lubricant column in the high-pressure chamber 50. In this mode of operation, lift from the cam lobe 26 is fully transferred via the finger 24 to the engine valve 18, yielding the primary valve lift. A micro lost motion, on the order of one-tenth of one millimeter, is due to the leakdown through the interface 59, during the valve event. This lost motion is strongly (to $3^{rd}$ power) dependent on the clearance at the interface 59. Hence, it is necessary to keep the clearance at the interface 59 at a small value.

Figure 5:
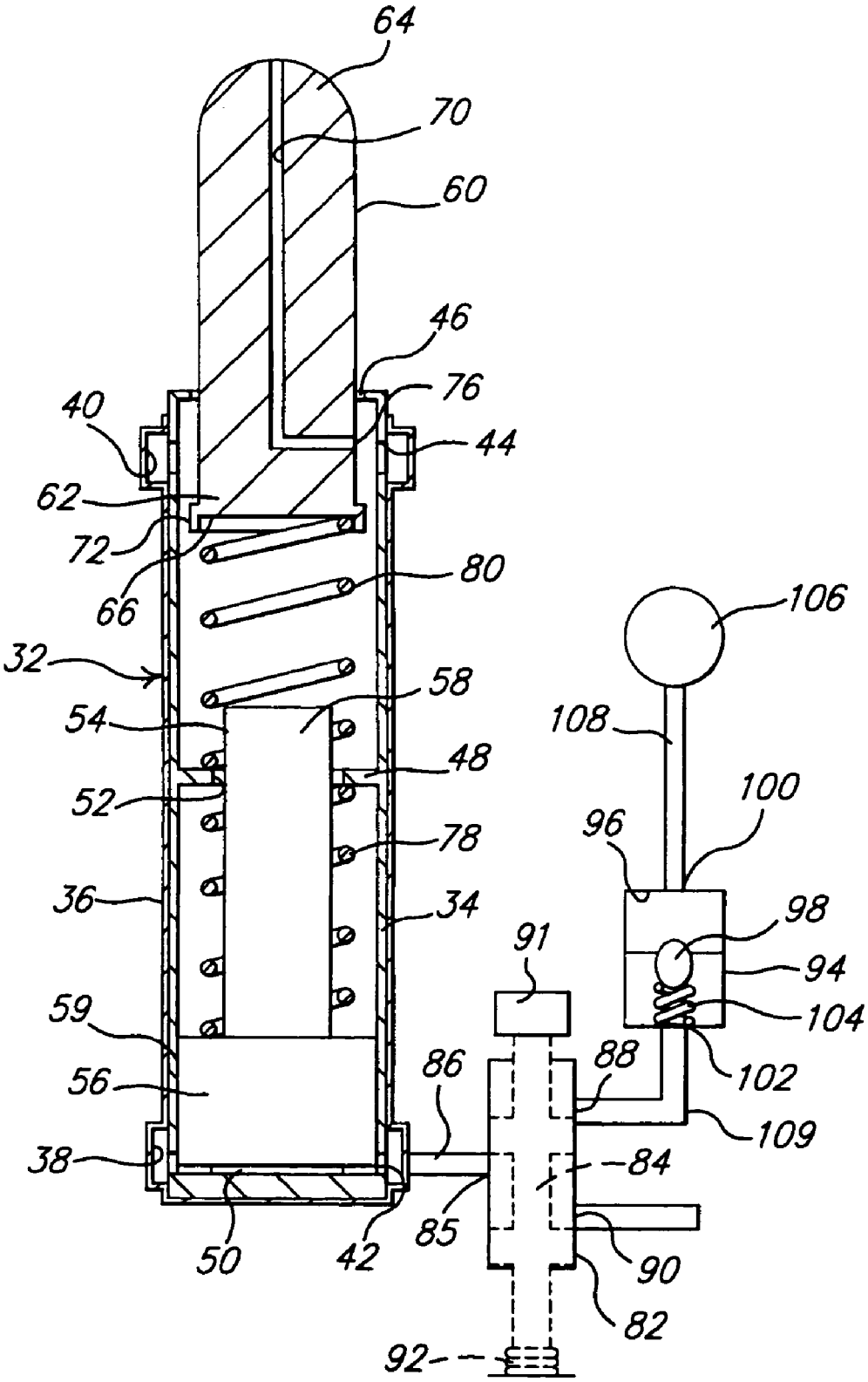

In an intermediate mode of the finger-support element assembly 32 as illustrated in FIG. 5, the control valve 82 is energized to communicate the high-pressure chamber 50 to sump at ambient pressure. The support piston 54 is displaced downward by its full stroke under the force of the first spring 78. It should be appreciated that there is a clearance between the top of the support piston 54 and the bottom of the pivot piston 60 so that there is no impact between the two upon full downward stroke of the pivot piston 60.

In the fully-collapsed (valve-deactivated) mode of the finger-support element assembly 32 as illustrated in FIG. 6, the support piston 54 is stationary, and the pivot piston 60 undergoes a reciprocating motion with a stroking distance corresponding to the lost motion. In this mode of operation, the engine valve 18 remains closed, and the input from the cam lobe 26 to the finger 24 is transferred to the pivot piston 60. During the reciprocating motion of the pivot piston 60, all parts of the valve actuator assembly 10 remain in contact due to the loading from the second spring 80. Low loading in the valve-deactivated mode results in a lower friction loss, for example, at the contact between the tip of the engine valve 18 and the pallet of the finger 24. A large clearance at the interface 72 ensures a lower viscous drag force, hence a lower power loss during the valve-deactivated mode. It should be appreciated that, because the reciprocating motion of the pivot piston 60 is biased against the second spring 80, which is supported on the ground as represented by the dividing wall 48, there is no need for a fluid support during this mode of operation. It should also be appreciated that this feature eliminates the power-consuming process of pumping a volume of fluid through a small orifice per valve event. It should further be appreciated that the finger-support element assembly 32 can be used in a valve-train system having two intake valves per cylinder where the corresponding cam lobes have different profiles, yielding either the primary or secondary lift, by itself, depending on which finger support element assembly 32 is active.

Figure 8:
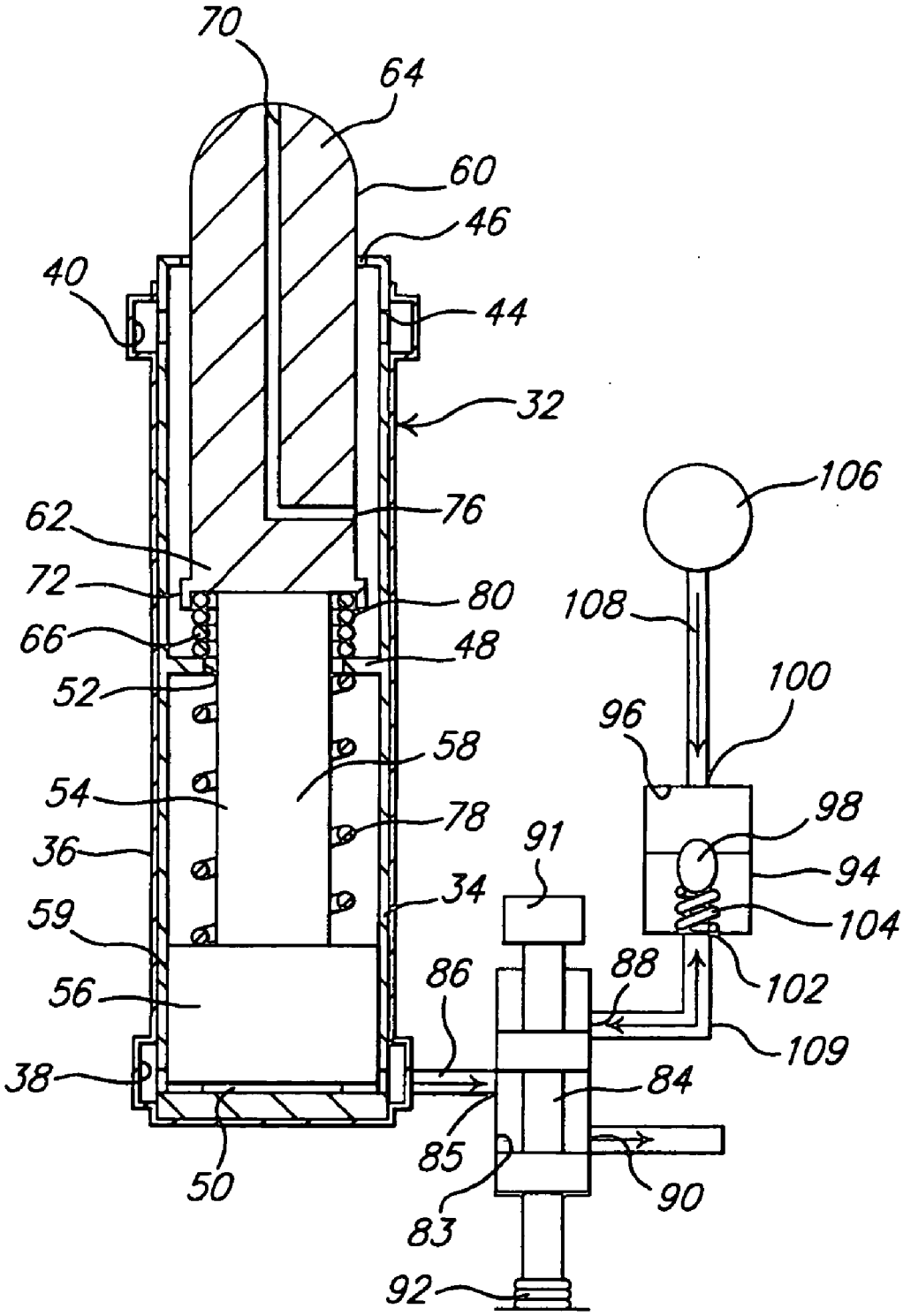
Figure 7:
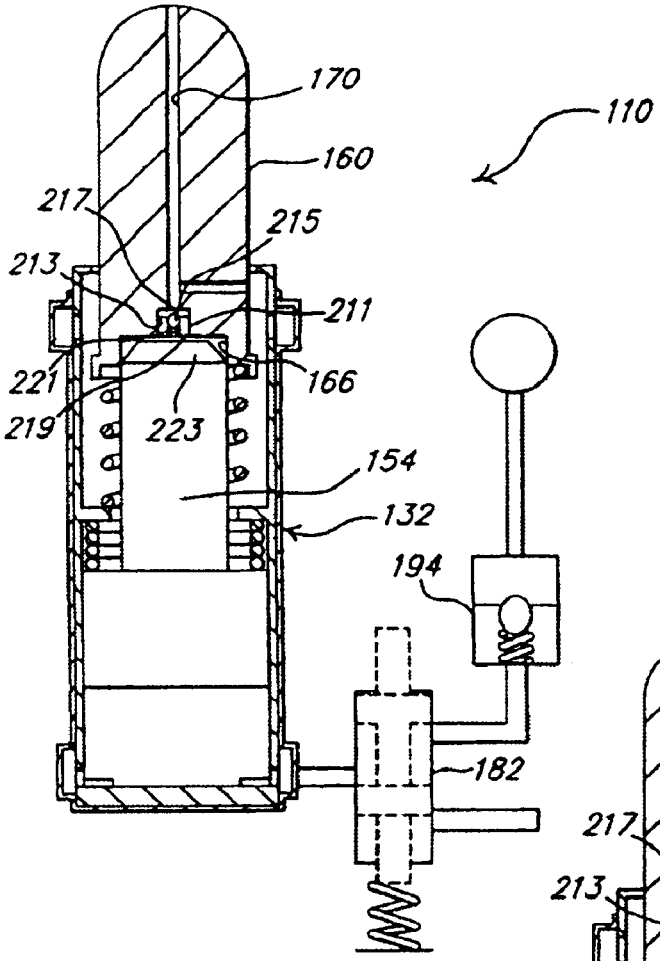
Figure 8:
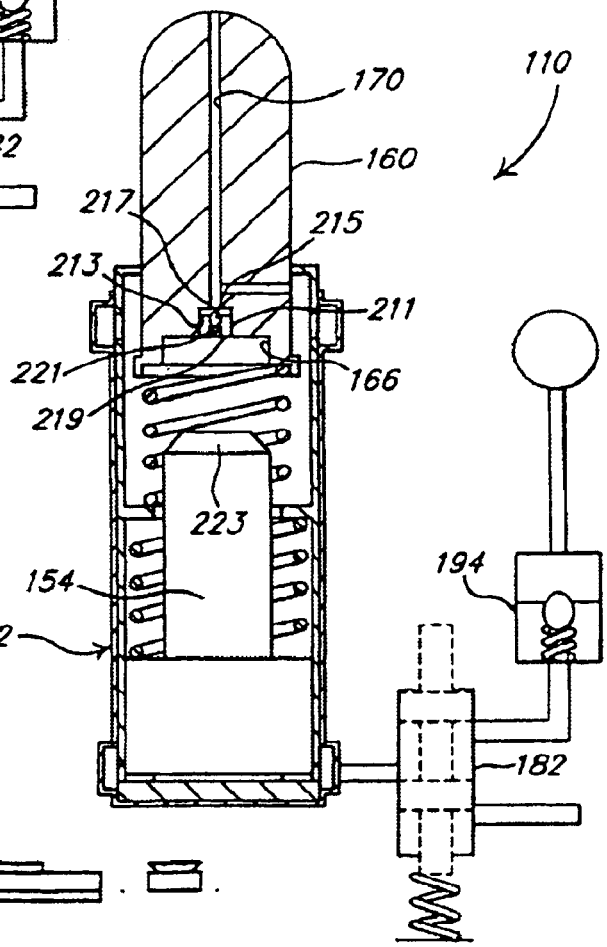
Figure 8:
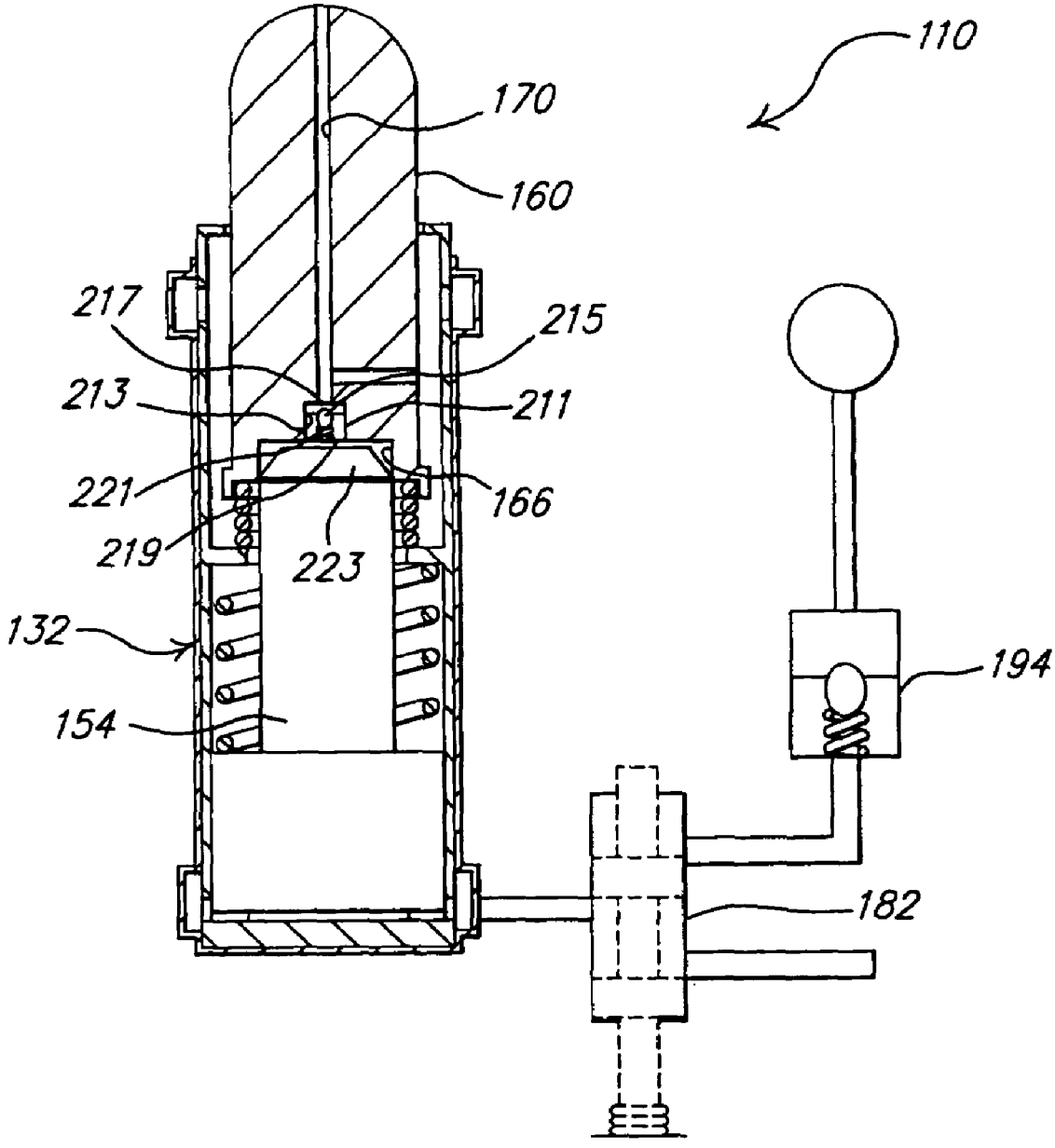

Referring to FIGS. 7 through 9, another embodiment, according to the present invention, of the valve actuator assembly 10 is shown. Like parts of the valve actuator assembly 10 have like reference numerals increased by one hundred (100). In this embodiment, the valve actuator assembly 110 includes the finger-support element assembly 132, the control valve 184, and the one-way flow valve 194. The valve actuator assembly 110 also includes a second one-way flow valve 211 in fluid communication with the lubricant channel 170 and cavity 166 of the pivot piston 160. In the embodiment illustrated, the second one-way flow valve 211 includes a chamber 213 within the first end 162 of the pivot piston 160 and communicating with the lubricant channel 170. The second one-way flow valve 211 also includes a movable valve element 215 disposed within the chamber 213. The valve element 215 is of a ball type. The second one-way flow valve 211 also includes an inlet pressure port 217 on the chamber 213 communicating with the lubricant channel 170 and an outlet pressure port 219 on the chamber 213 communicating with the cavity 166. The second one-way flow valve 211 also has a valve element spring 221 at one end of the valve element 215 to bias the valve element 215 toward one end of the chamber 213.

The valve actuator assembly 110 also includes the support piston 154 and the pivot piston 160. The tip of the support piston 154 has a tapered profile 223, which plunges into the receiving straight-edged cavity 166 at the bottom of the pivot piston 160. It should be appreciated that the second one-way flow valve 211 ensures the presence of lubricant in the cavity 166 prior to the onset of the damping, and restricts flow out of the cavity 166 during the damping transient where the cavity lubricant pressure increases.

In operation of the valve actuator assembly 110, damping occurs at the interface between the pivot piston 160 and the support piston 154 to achieve two discrete (i.e., two-step) valve lift profiles. The valve actuator assembly 110 operates similar to the valve actuator assembly 10, except that the lost motion stroke is shorter. As illustrated in FIG. 7, the finger-support element assembly 132 is in the fully-expanded mode, yielding the primary lift. As illustrated in FIG. 8, the finger-support element assembly 132 is in the partially-collapsed mode, before which the second one-way flow valve 211 acts as a simple damper for the soft landing of the pivot piston 160. As illustrated in FIG. 9, the finger-support element assembly 132 is in the fully-collapsed mode, yielding the secondary lift. It should be appreciated that the overall height of the finger-support element assembly 132 is shorter than the finger-support element assembly 32 because the required lost-motion stroke for the two-stepping is shorter. It should also be appreciated that the magnitude of the lost-motion stroke determines the desired maximum value of secondary valve lift. It should further be appreciated that two identical cam lobes 26, by using the finger-support element assembly 132, can simultaneously yield either the primary lifts or the secondary lifts. It should still further be appreciated that, if desired, a combination of one primary and one secondary lift per cylinder can also be achieved by deactivating one of the finger-support element assemblies 132.

Figure 10:
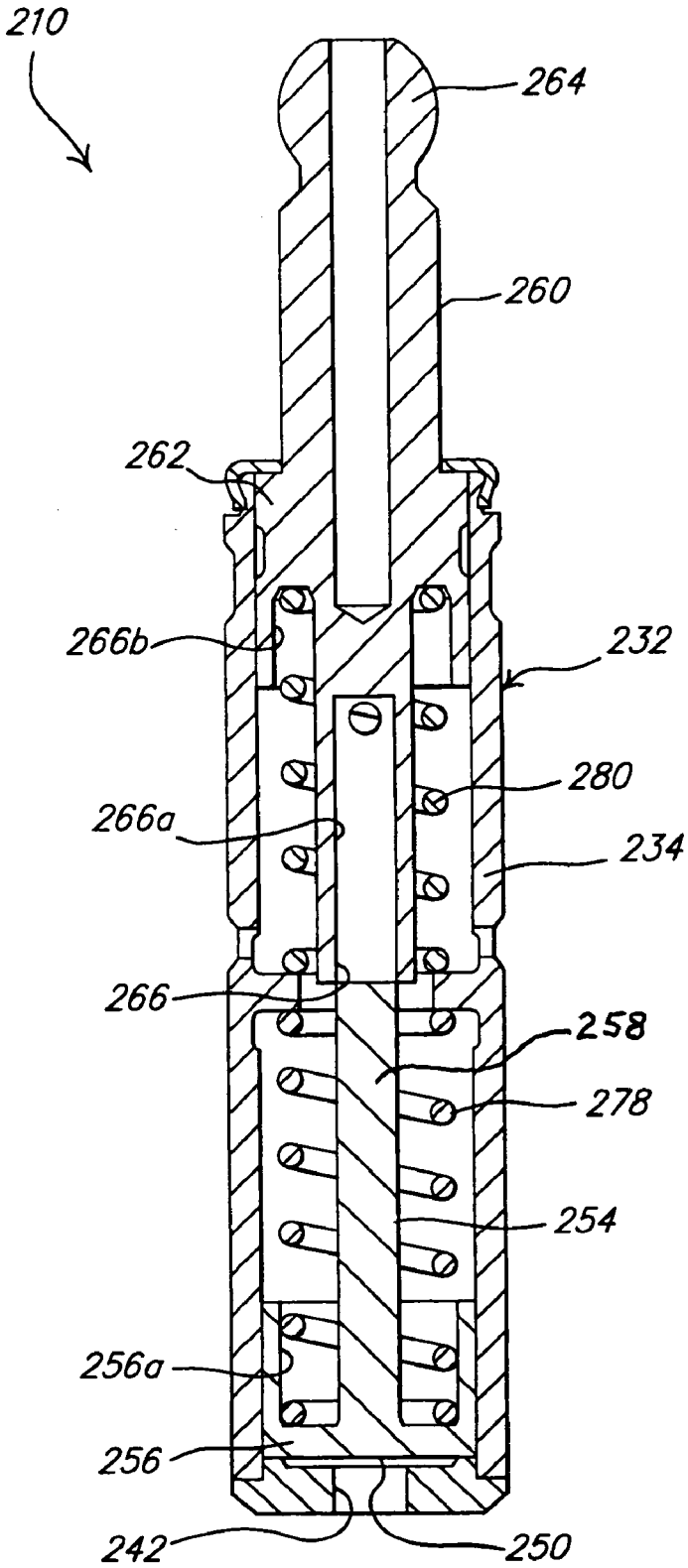
FIG. 10 is a fragmentary elevational view of yet another embodiment, according to the present invention, of the valve actuator assembly of FIG. 1.

Referring to FIG. 10, yet another embodiment, according to the present invention, of the valve actuator assembly 10 is shown. Like parts of the valve actuator assembly 10 have like reference numerals increased by two hundred (200). In this embodiment, the valve actuator assembly 210 includes the finger-support element assembly 232, which is functionally the same as the embodiment shown in FIG. 5, except for several additional features providing better structural integrity and reduced overall size. In particular, the finger support element assembly 232 includes the movable pivot piston 260 partially disposed within the outer housing 234. The pivot piston 260 extends axially and has a first end 262 for contact with the one end of the shaft 258 of the support piston 254 and a second end 264 for contact with the finger 24. The first end 262 includes a cavity 266. The cavity 266 of is divided into two sections, a first section **266*a* for receiving the shaft 258 of the support piston 254, and a second section 266*b* for housing the compressed height of the second spring 280**.

Similarly, the finger support element assembly 232 includes the movable support piston 254 disposed within the outer housing 234. The support piston 254 has the head 256 extending radially and the shaft 258 extending axially from the head 256. The head 256 includes a cavity **256*a* for housing the compressed height of the first spring 278 when the shaft 258 is fully inserted into the first section 266*a* of the cavity 266**.

In addition, the finger support element assembly 232 includes the outer housing 234 having the opening or passageway 242 located at the bottom center of the high-pressure chamber 250. The operation of the valve actuator assembly 210 is similar to the valve actuator assembly 10.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A valve actuator assembly for an engine comprising:

a movable engine valve;

a movable finger for contact with said engine valve;

a rotatable cam for contact with said finger;

a finger-support element assembly for contact with said finger comprising a housing, a first piston and a second piston disposed in said housing, said first piston and said second piston being axially aligned and independently movable in the same direction to provide full lift of said engine valve in an activated mode and lost motion of said engine valve in a de-activated mode; and wherein said first piston and said housing have a first radial clearance to control leak-down of high-pressure fluid supporting said first piston in an engine valve fully-active mode and said second piston and said housing have a second radial clearance to enable high-speed reciprocating motion of said second piston when said engine valve is not fully active, said second radial clearance being greater than said first radial clearance.

2. A valve actuator assembly as set forth in claim 1 wherein said housing includes a dividing wall forming a chamber therein.

3. A valve actuator assembly as set forth in claim 2 wherein said first piston comprises a head being disposed in said chamber and a shaft extending axially from said head and through an aperture in said dividing wall.

4. A valve actuator assembly as set forth in claim 3 wherein said finger-support element assembly includes a spring disposed in said housing and about said shaft between said head and said dividing wall to urge said head away from said dividing wall.

5. A valve actuator assembly as set forth in claim 2 wherein said second piston is partially disposed in said housing and extends axially through an aperture in said housing for contact with said finger.

6. A valve actuator assembly as set forth in claim 5 wherein said finger-support element assembly includes a spring disposed in said housing between said dividing wall and said second piston to urge said second piston away from said dividing wall.

7. A valve actuator assembly as set forth in claim 2 wherein said second piston has a hollow shaft extending axially from a head of said second piston and receives a shaft of said first piston extending through an aperture of said dividing wall, thereby providing structural stiffness against side loading of said second piston.

8. A valve actuator assembly as set forth in claim 1 including a control valve fluidly communicating with said first piston of said finger-support element assembly and a fluid source.

9. A valve actuator assembly as set forth in claim 8 including a one-way flow valve fluidly communicating with said control valve and the fluid source, and hydraulically enabling displacement of said first piston in a direction to contact and support said second piston, and also preventing the displacement of said first piston away from contacting and supporting said second piston when the engine valve is fully active.

10. A valve actuator assembly as set forth in claim 1 wherein said second piston has a lubricant channel extending therethrough to provide a lubricant flow to the contact between said finger and said second piston.

11. A valve actuator assembly as set forth in claim 10 including a one-way flow valve fluidly communicating with said lubricant channel of second piston of said finger-support element assembly, permitting the filling of a damping chamber when said first and second pistons are apart from each other.

12. A valve actuator assembly for an engine comprising:

a movable engine valve;

a movable finger for contact with said engine valve;

a rotatable cam for contact with said finger;

a finger-support element assembly for contact with said finger comprising a first piston and a second piston, said first piston and said second piston being axially aligned and independently movable in the same direction to provide full lift of said engine valve in an activated mode and lost motion of said engine valve in a de-activated mode;

said second piston having a lubricant channel extending therethrough to provide a lubricant flow to the contact between said finger and said second piston;

a one-way flow valve fluidly communicating with said lubricant channel of second piston of said finger-support element assembly, permitting the filling of a damping chamber when said first and second pistons are apart from each other; and wherein said one-way flow valve prevents flow out of the damping chamber when a tip of said first piston plunges into the damping chamber on said second piston, providing soft landing of said second piston on said first piston, thereby enabling a secondary lift of said engine valve with partial lost motion.

13. A valve actuator assembly comprising:

a movable engine valve;

a movable finger for contact with said engine valve;

a rotatable cam for contact with said finger;

a finger-support element assembly for contact with said finger comprising a housing, a first piston disposed in said housing, a second piston being partially disposed in said housing and axially aligned with said first piston, a first spring disposed in said housing to urge said first piston away from said second piston, and a second spring disposed in said housing to urge said second piston into contact with a rocker arm, said first piston and said second piston being independently movable in the same direction to provide lift of said engine valve in an activated mode and lost motion of said engine valve in a de-activated mode; and wherein said first piston and said housing share a common interface that has a sufficiently small radial clearance to control leak-down of high-pressure fluid supporting said first piston in an engine valve fully-active mode and said second piston and said housing share a common interface that has a sufficiently large radial clearance to enable high-speed reciprocating motion of said second piston when the engine valve is not fully active.

14. A valve actuator assembly as set forth in claim 13 wherein said housing includes a dividing wall forming a chamber therein.

15. A valve actuator assembly as set forth in claim 14 wherein said first piston comprises a head being disposed in said chamber and a shaft extending axially from said head and through an aperture in said dividing wall.

16. A valve actuator assembly as set forth in claim 15 wherein said first spring is disposed about said shaft between said head and said dividing wall to urge said head away from said dividing wall.

17. A valve actuator assembly as set forth in claim 13 wherein said second piston extends axially through an aperture in said housing for contact with said finger and said second spring is disposed between said dividing wall and said second piston to urge said second piston away from said dividing wall.

18. A valve actuator assembly as set forth in claim 13 including a control valve fluidly communicating with said first piston of said finger-support element assembly and a fluid source.

19. A valve actuator assembly as set forth in claim 18 including a first one-way flow valve fluidly communicating with said control valve and the fluid source, and hydraulically enabling displacement of said first piston in a direction to contact and support said second piston, and also preventing the displacement of said first piston away from contacting and supporting said second piston when the engine valve is fully active.

20. A valve actuator assembly as set forth in claim 13 wherein said second piston has a lubricant channel extending therethrough to provide a lubricant flow to the contact between said finger and said second piston.

21. A valve actuator assembly as set forth in claim 20 including a second one-way flow valve fluidly communicating with said lubricant channel of second piston of said finger-support element assembly, permitting the filling of a damping chamber when said first and second pistons are apart from each other.

22. A valve actuator assembly as set forth in claim 13 wherein said first piston has a first head and said second piston has a second head, said first head and said second head both including a hollow section formed concentrically around their respective shafts to house a compressed thickness of said first and second springs, respectively.

23. A valve actuator assembly comprising:

a movable engine valve;

a movable finger for contact with said engine valve;

a rotatable cam for contact with said finger;

a finger-support element assembly for contact with said finger comprising a housing, a first piston disposed in said housing, a second piston being partially disposed in said housing and axially aligned with said first piston, a first spring disposed in said housing to urge said first piston away from said second piston, and a second spring disposed in said housing to urge said second piston into contact with a rocker arm, said first piston and said second piston being independently movable in the same direction to provide lift of said engine valve in an activated mode and lost motion of said engine valve in a de-activated mode;

said second piston having a lubricant channel extending therethrough to provide a lubricant flow to the contact between said finger and said second piston;

a one-way flow valve fluidly communicating with said lubricant channel of second piston of said finger-support element assembly, permitting the filling of a damping chamber when said first and second pistons are apart from each other; and wherein said one-way flow valve prevents flow out of the damping chamber when a tip of said first piston plunges into the damping chamber on said second piston, providing soft landing of said second piston on said first piston, thereby enabling a secondary lift of said engine valve with partial lost motion.

24. A valve actuator assembly comprising:

a movable engine valve;

a movable finger for contact with said engine valve;

a rotatable cam for contact with said finger;

a finger-support element assembly for contact with said finger comprising a housing, a first piston disposed in said housing, a second piston being partially disposed in said housing and axially aligned with said first piston, a first spring disposed in said housing to urge said first piston away from said second piston, and a second spring disposed in said housing to urge said second piston into contact with a rocker arm, said first piston and said second piston being independently movable in the same direction to provide lift of said engine valve in an activated mode and lost motion of said engine valve in a de-activated mode;

said housing including a dividing wall forming a chamber therein; and wherein said dividing wall provides a common ground support for said first spring and said second spring enabling said first spring to be sufficiently soft and compressible at low fluid pressures, and enabling said second spring to be sufficiently stiff controlling valve train stiffness when the engine valve is not fully active.

25. A valve actuator assembly as set forth in claim 14 wherein said second piston has a hollow shaft extending axially from a head of said second piston and receives a shaft of said first piston extending through an aperture of said dividing wall, thereby providing structural stiffness against side loading of said second piston.

* * * * *